United States Patent [19]

Payne

[11] 4,085,973

[45] Apr. 25, 1978

[54] OCEAN FLOOR SURFICIAL DREDGING APPARATUS

[76] Inventor: John C. Payne, 23-51-32 St., Long Island City, N.Y. 11105

[21] Appl. No.: 736,226

[22] Filed: Oct. 27, 1976

[51] Int. Cl.[2] ..... E21C 45/00

[52] U.S. Cl. ..... 299/8; 56/328 R; 73/425.2

[58] Field of Search ..... 294/66 R, 66 A; 56/8, 56/328 R; 299/8; 175/5; 73/425.2

[56] References Cited

U.S. PATENT DOCUMENTS

| | | | |
|---|---|---|---|
| 2,788,630 | 4/1957 | Nisbet | 56/328 R |
| 2,972,851 | 2/1961 | Goehring | 56/328 R |
| 3,509,772 | 5/1970 | Blair | 175/5 X |
| 3,848,682 | 11/1974 | Payne | 175/5 |

*Primary Examiner*—Ernest R. Purser

*Attorney, Agent, or Firm*—Leslie J. Payne

[57] ABSTRACT

An ocean floor surficial dredging apparatus is contemplated for retrieving particulate minerals from on and below the ocean floor. Such apparatus comprises first means for providing sufficient downward driving forces for enabling the first means to at least partially penetrate the ocean floor. The apparatus embodies second means operatively connected to the first means and actuable for providing sufficient positive buoyant force for extricating the first means from the seabed and returning it to the ocean surface. Also envisioned, such apparatus includes a third means operatively connected to the first means for permitting passage, therepast, of the particulate minerals whenever downwardly penetrating the seabed and for trapping particulate minerals of predetermined sizes in the first means, whenever, the first means is being extricated from the seabed in response to the actuations of the second means.

7 Claims, 12 Drawing Figures

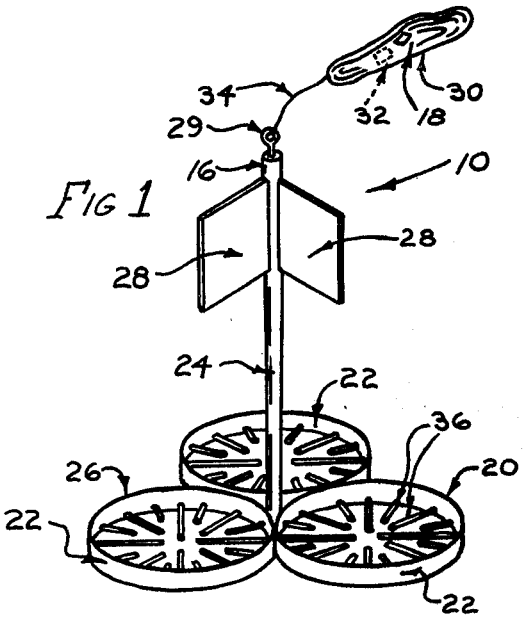
FIG 1
FIG 7A
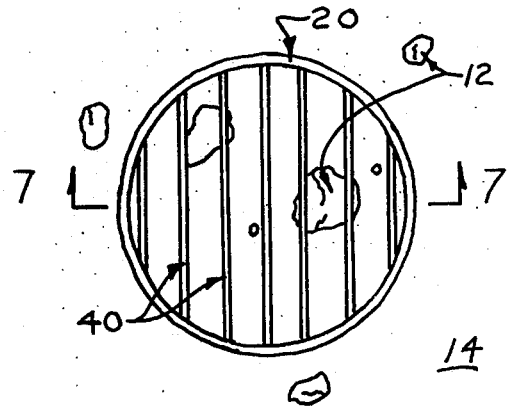
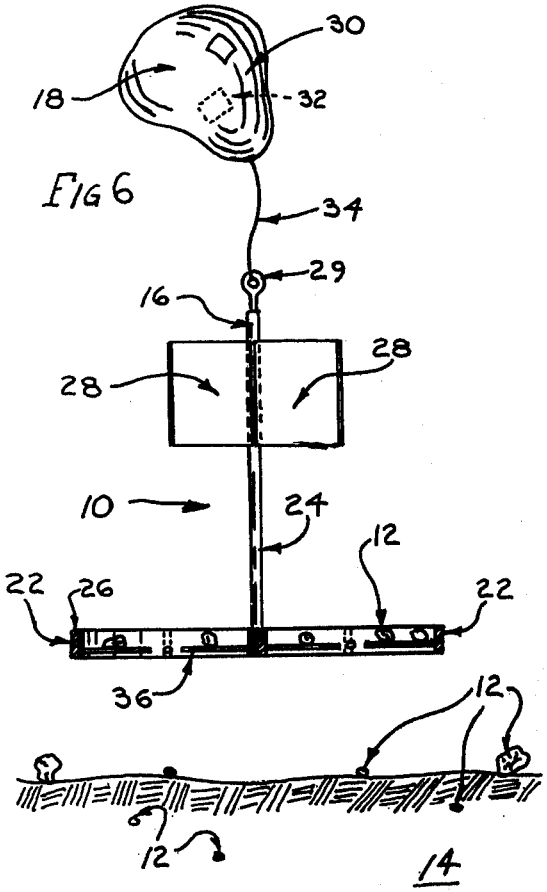
FIG 6
FIG 7
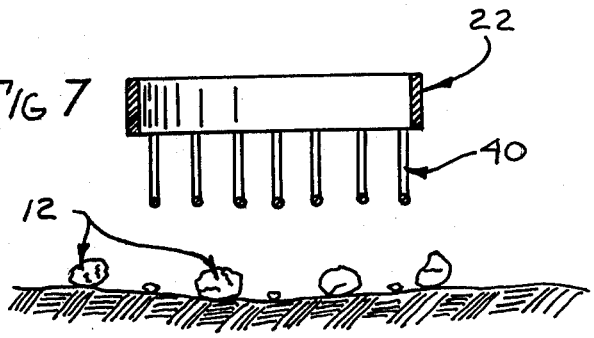

OCEAN FLOOR SURFICIAL DREDGING APPARATUS

BACKGROUND OF THE INVENTION

1. Field of the Invention

In general, this present invention pertains to the retrieval of natural resources from the seabed. More particularly, it is directed to a novel and improved ocean floor surficial dredging apparatus which will retrieve simply and economically particulate resources from on and below the seabed surface, especially in deep environments.

2. Description of Prior Art

The ocean and seabeds possess enormous deposits of mineral wealth which is particularly useful for a wide variety of industrial purposes. Generaly speaking, a substantial number of drawbacks are associated with the ordinary retrieval techniques heretofore applied in retrieving minerals. Foremost among these difficulties, from a technological standpoint, is the fact that the mining operations must be conducted in a marine environment. Such environment, of course, presents a significant number of inherently unique conditions, such as exceedingly high water pressure, varying seabed compositions and topographical environments, and the adverse effects of sea water, as is believed evident. These conditions are usually not encountered in the vast majority of present day mining situations. Such, of the previously mentioned disadvantages are further compounded in those circumstances where the mining to be carried out in deep sea situations.

It should also be pointed out that the method of exploitation, the character of the mineral deposits, and the specific environment under which the deposits are to be retrieved define important considerations in ascertaining whether or not a particular deposit can be successfully and economically extracted. Heretofore known devices have been unable to economically retrieve the particulate minerals.

One general category of the multitude of minerals distributed throughout the ocean and ocean floor is found in the form of particular types of pelagic sedimentation. Such types take a number of physical forms including grains, slabs, and other important forms of agglomerated colloidal particles. For instance, it has been discovered that some of these forms are typically dispersed on the bottom in a monolayer and ordinarily average from 0.5, to 2.50 cm. in diameter. Furthermore, such dispersions have been located at exceedingly deep depths, some over 5,000 meters. It can be readily appreciated that at such depths there is a tremendous amount of water pressure to contend with not to mention the various types of seabed compositions and ocean currents. As a result of the foregoing, successful mining has been substantially hindered.

In general known attempts to retrieve such minerals have not been successful, particularly from an economic standpoint. Approaches employed for purposes of retrieving minerals; through the application of drag dredge devices, or bucket dredge devices. Either approach is severely limited by reason of the exceedingly long cables necessary to dredge the ocean bottom. Moreover, the power machinery including winches and booms are placed under severe fatigue loading conditions requiring constant maintenance not to mention the expensive cost of operation.

Another manner of retrieving marine sediment maybe achieved through utilization of free fall coring apparatuses. Such known coring devices while suitable for some certain purposes are not especially suitable for automatically, selectively and exclusively retrieving particulate sediment of predetermined sizes. Moreover, they are, in general, characterized by relatively numerous and costly components, not to mention complicated construction and burdensome weight release mechanisms. It will of course be recognized that by virtue of such apparatuses having relatively large numbers of components there also exists a tendency for them to fail or otherwise function unsatisfactorially. This is especially so in situations wherein the several moving and mechanically interrelated components are subjected to exceedingly high water pressure and must extract minerals on or embedded in the sea floor. Accordingly, in view of the foregoing numerous drawbacks known methods and apparatuses utilizing in the field of ocean mining to retrieve particulate materials from the seabed have been unable to do so in a manner which is relatively economical, effective, and reliable in operation.

SUMMARY OF THE INVENTION

It is therefore, an object of this invention to overcome the aforementioned significant disadvantages associated with the contemporary approaches that have been thus far undertaken towards the simple reliable and economical retrieval of particulate mineral resources on and in the seabed, especially the very deep seabed. To this end there is provided a novel and improved apparatus for retrieving such mineral resources in a simple, reliable and economical fashion.

Briefly, in accordance with the principles of the instant invention, there is contemplated a first means for providing sufficient downward driving force for enabling the first means to at least partially penetrate the ocean seabed. The apparatus further includes second means operatively connected to the first and actuable for providing sufficient positive buoyant force for extricating the first means from the seabed and returning it to the ocean surface. Third means are operatively connected to the first means for permitting passage of the particulate minerals on and embedded in the seabed surface therepast and into the first means whenever downwardly penetrating the seabed, and for automatically and exclusively trapping particulate minerals of predetermined sizes whenever the first means is extricated from the seabed ascending towards the ocean surface in response to actuation of the second means.

BRIEF DESCRIPTION OF THE DRAWINGS

The above and other objects, features, and advantages of this invention will become apparent upon reading of a detailed description of an apparatus embodying the principles of the present invention when viewed in conjunction with the accompanying drawings wherein like reference numerals depict like structure throughout the several views.

FIG. 1 is a diagrammatic perspective view showing a novel and improved surficial dredging apparatus of the instant invention;

FIG. 6 is an elevational type of diagrammatic view partly broken away, showing the surficial dredging apparatus in the process of ascent towards the ocean surface and carrying away particulate minerals from the ocean seabed surface.

FIG. 7 is an enlarged fragmented diagrammatic side elevational view of a modification of the retaining fingers of the present invention; and FIG. 7A is a plan view of the modification shown in FIG. 7;

DETAILED DESCRIPTION

Figure 2:
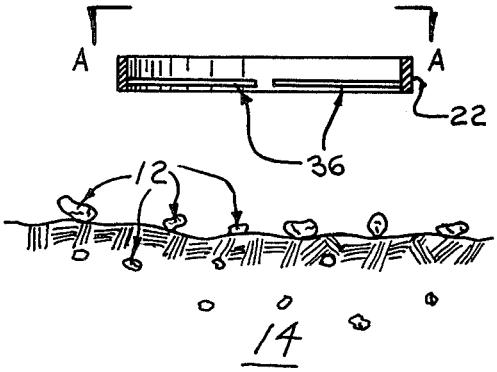
FIG. 2 represents a broken away side elevational view illustrating one of the retrieving elements above particulate minerals located on the seabed.

Referring now to the drawings and specifically FIG. 1 there is illustrated one embodiment of the surficial retrieval apparatus of the present invention which is generally designated by reference numeral 10. As will subsequently made clear, the retrieval apparatus 10 may be used for purposes of automatically, selectively, simply and reliably retrieving various types of pelagic sedimentation, especially in the form of particulate matter 12 of preselected size from on and embedded in the top layer of the ocean seabed 14. Although the surficial retrieval apparatus 10 can be used in retrieving nodule type mineral at any depth of water, such apparatus is particularly advantageous in deep sea environments for reasons afterwards made clear. Surficial retrieval apparatus 10 essentially includes first or supporting means 16, second or lifting means 18, and third or trapping means 20.

In connection with the supporting means 16, such may include generally tubular retrieving members 22 having opposite opened ends. Retrieving members 22 may be suitably fastened, as by welding, to a central supporting post 24. Although, the illustrated embodiment depicts three symmetrically oriented retrieving members 22 about post 24 other suitable members may be employed without departing from the spirit and scope of this invention. Additionally, the supporting members 22 may have a wide variety of shapes and sizes besides the cylindrical form depicted. Retrieving members 22 are formed with a generally thin annular tubular wall 26. It should be pointed out that the retrieving members 22 are arranged to at least partially penetrate the ocean seabed 14. The significance of such penetration will be presently discussed.

Supporting means 16 may also include stabilizing fins which are suitably secured to the supporting post 24 and can have a generally flat configuration. Fins 28 extend radially outward and serve to enhance control over the descent and ascent of the apparatus 10 in a well-known manner. Attached at the free end of the supporting post 24 may be any convenient form of attachment device 24 as for example a standard threaded eye bolt 29. Other forms of attachment devices of course may be utilized. The eye bolt 29 functions to secure the lifting means 18 to the supporting post 24 to thereby enable the latter to suitably lift the former.

It should be emphasized that supporting means 16 is so formed that it will penetrate the sediment with a predetermined momentum. For instances, such momentum can be approximated by the product of the velocity and the difference between the weight of the apparatus 10 and any drag force encountered during the descent. This momentum should be selected such that it is less than the lifting forces created by lifting means 18. The particular significance of this relationship will be afterwards emphasized.

As concerns the lifting means 18 it can include an enclosed expandable member 30, self-contained gas generating means 32 and flexible cable 34. Expandable member 30 is fabricated from any suitable material. Preferably, it should be able to withstand significant pressures and repeated inflations. Flexible cable 34 serves to interconnect expandable member 30 to post 24. Member 30 descends in a collapsed state towards the seabed 14. Expansion of expandable member 30 serves to provide a sufficient positive buoyant force which lifts retrieving members 22, post 24 and trapping means 20. It will be understood that the magnitude of the positive buoyant force is selected so as to be sufficient for purposes of extricating retrieving members 22 with trapping means 20 and selected particulate 12 from the seabed.

A gas generating means 32 may be a suitable self-contained unit appropriately housed within expandable member 30. Essentially the gas generating means 32 functions to produce a large volume of gas within the expandable member 30 so as to correspondingly expand the latter and lift it and the supporting means 16 and trapping means 20 toward the ocean surface.

One particular gas generating means 32 may be essentially comprised of solid carbon dioxide which will, in a well known manner, change phase from a solid to gaseous form in response to changes in environmental conditions surrounding the expandable member 30. The commencement and rate of expansion of expandable member 30 can be appropriately controlled, so that such commencement occurs after the supporting members 22 have at least partially penetrated the seabed 14.

It will be recognized of course, that other various types of conventional gas generating means may be realized as being within the spirit and scope of this invention.

Other known mechanisms and arrangements may be realized for providing a rapid and sufficient discharge of a gaseous medium so as to inflate expandable member 30. As earlier observed the positive bouyant force created should be of a magnitude that will cause extrication of retrieving members 22, trapping means 20 and particulate material 12.

The positive buoyant force is selected such that it is relatively less in magnitude than the downward driving forces generated by the apparatus 10 during free fall toward the seabed 14. The downward driving force and buoyant force necessary to effect a successful operation of surficial dredging apparatus 10 can be computed in a conventional manner. The particular significance of the foregoing relationship will be afterwards more adequately described. Moreover, the buoyant forces are selected so as to lift apparatus 10 regardless of ocean depth.

Figure 3:
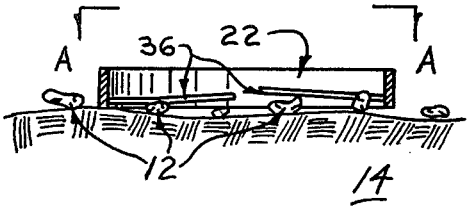
FIG. 3 represents a broken away side elevational view depicting one of the retrieving elements in the process of penetrating the seabed and having the retrieving elements pass around the particulate minerals.
Figure 3A:
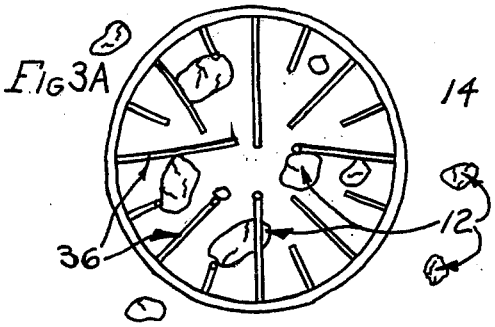
FIG. 3A represents a plan view of the retrieving elements in FIG. 3, shown accomodating particulate elements of predetermined size found on the seabed.
Figure 4:
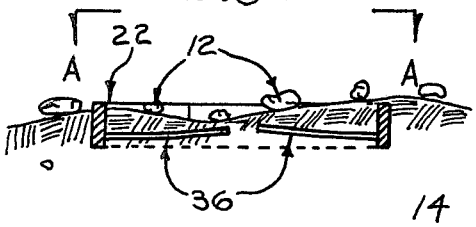
FIG. 4 represents another broken away side elevational view similar to FIGS. 2 and 3, and illustrating the retaining fingers cooperating with the particulate minerals of the seabed during ascent of the retrieving apparatus from such seabed.
Figure 4A:
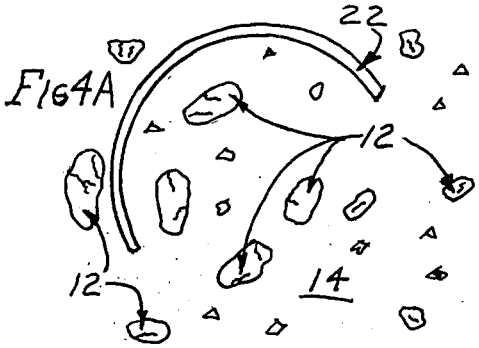
FIG. 4A illustrates in plan view the arrangement of particulate elements as shown in FIG. 4.
Figure 5:
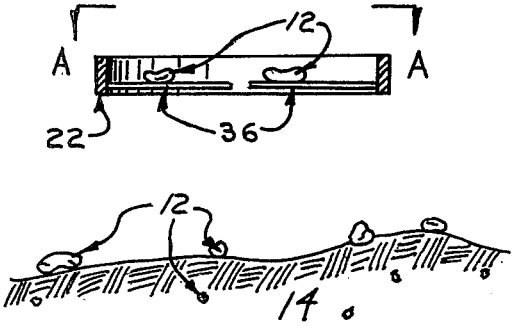
FIG. 5A is a plan view of one of the retrieving elements depicted in FIG. 5.
Figure 5A:
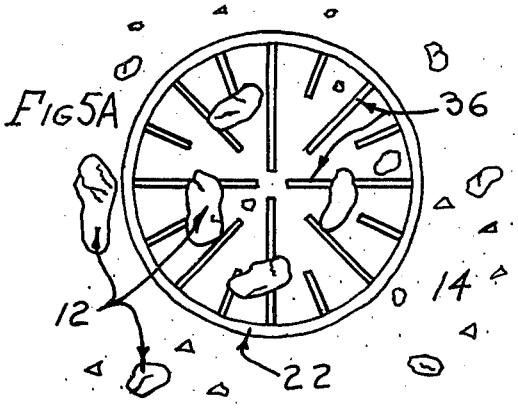

Now turning to the novel and improved trapping means 20 of this embodiment such is seen to include a plurality of generally semi-flexible elongated fingers 36. Fingers 36 are affixed at one end to the lower end of the retrieving members 22 and extend radially inward. As best viewed in FIG. 2A each of the semiflexible fingers 36 are equidistantly spaced from each other. The free ends of the fingers 36 are in this embodiment arranged in a pattern for retrieving particulate of preselected sizes. By virtue of the arrangement of fingers 36 it will be understood that the spaces existing there between appropriately permit sediment of smaller sizes to pass the fingers. In this embodiment the fingers 36 are arranged in spoke fashion with alternate fingers being longer than adjacent fingers. Such arrangement tends to optimize the number of particles retained while minimizing the undesirable tendency to retrieving unwanted sizes of particulate during penetration and extrication. Such spacing also facilitates penetration and extrication. On the other hand, the spacing also determines the size of the particulate material to be carried to the ocean surface by the fingers 36. Stated somewhat differently the fingers 36 will lift and carry the particulate whenever such material has a dimension which material exceeds the spacing between the fingers 36 whenever the latter in their normal undeformed condition. To insure that the fingers do not force downwardly the desired sized particulate material and to facilitate the lifting operation, the fingers 36, as mentioned earlier are made from a suitable semi-flexible material. Generally such a material could be a noncorrosive spring steel. Other appropriate materials may also be used. Semiflexible fingers 36 are formed from a material which will slightly bend whenever the apparatus 10 under sufficient predetermined downward force penetrates the seabed 14 and contacts relatively large and heavy particulate. Accordingly, any relatively large particulate larger than the spacing between the fingers will engage the fingers 36 and cause them to slightly spread apart much in the manner indicated in FIG. 3A. Thus the relatively large particles are permitted to pass within the retrieving members 22. By reason of the inherent resiliency of fingers 36 they will resume their nondeformed shape after the large particulate materials move therepast. As a consequence thereof particulate material 12 is generally situated above the fingers 36 whenever the apparatus 10 comes to rest, such as shown in FIGS. 4 and 4A. The apparatus 10 is not designed to penetrate very deeply since it is desirable to minimize the extricating force. It will be, of course, further appreciated that the other particulate matter forming the seabed will easily pass through such fingers both during penetration and extrication. As a result thereof, the dredging apparatus 10 can perform the extricating operation without need for retrieving undesired particulate matter.

Figure 2A:
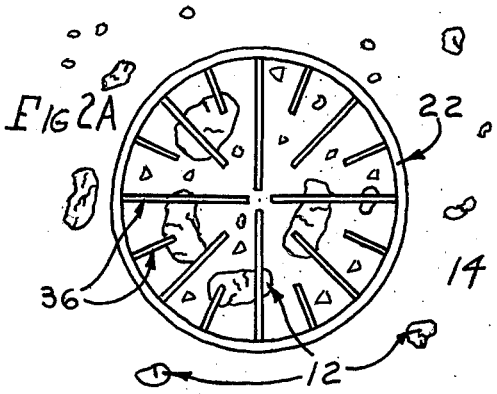
FIG. 2A represents a plan view of one of the retrieving elements of this invention depicting a preferred arrangement of retaining fingers carried thereby.

The circumferential spacing between fingers 36 depicted in FIG. 2A is for purposes of illustration and not limitation. In this embodiment such may preferably vary from 4 to 4 to 25 cm. Alternate spacing dimensions can be easily provided depending upon the size of the particulate to be retrieved. Such spacing may be measured between adjacent fingers 36 at the points the fingers join the retrieving members 22.

After having explained the foregoing organization of components it is believed the operation of the surficial dredging apparatus 10 is self-evident. However, to supplement such description reference is made to FIGS. 2 through 5 to illustrate the sequence of operation of apparatus 10. The surficial dredging apparatus 10 under its own downwardly driving forces will at least partially penetrate seabed 14. During this particular action the large particulate material of a size greater than the spacing between fingers 36 will force the latter to spread apart upon contact, such as depicted in FIG. 3A. In this fashion the particulate material 12 will be accomodated within retrieving members 22 above the retaining fingers 36. Since the fingers 36 are semi-flexible they, under their own resiliency, assume their underformed condition such as depicted in FIG. 2A.

Once the gas generating means 32 develops sufficient gas within expandable member 30 the latter will expand and rise with sufficient positive buoyant force. Correspondingly, cable 34 eventually pulls on supporting means 16 including the retaining fingers 36. Retaining fingers 36 will therefore engage the underneath surface of particulate material 12 and lift the same. During the lifting action the buoyant force is selected to be of relatively less magnitude than the downward driving forces of the apparatus 10, so that fingers 36 will gradually rise upwardly through the seabed 14 and not have fingers 36 bend or spread apart upon as during penetration. Thus the lifting action of supporting means 16 including fingers 36 simultaneously raises the particulate materials 12 from on and in the seabed surface 14.

The expanding member 30 continues to rise towards the ocean surface, whereby apparatus 10 maybe advantageously recovered.

As is believed quite evident any seabed particulate not being sufficiently large to be trapped by the fingers 36, passes between the fingers 36 and will remain on the surface 14. This latter feature is beneficial from an ecological standpoint since the remaining particles 12 will facilitate future growth of these palegic minerals. Also the remaining nodules will still allow the marine life in the associated area to remain and proliferate.

By reason of the preceding constructional arrangement, there is provided an extremely simple device which automatically, selectively, simply, and advantageously retrieves particulate matter of preselected size from on and in the seabed.

Specifically referring to FIGS. 7 and 7A there is illustrated another embodiment of this invention. Similar structure of this embodiment will be represented by like reference numerals with however the addition of a prime marking. Since in this embodiment the dredging apparatus 10 is the same as in the previous embodiment with the exception of the trapping means 20, only the trapping means 20 will be discussed. As illustrated in solid lines retrieving member 22 has trapping means 20 associated therewith and is shown prior to penetration. In this particular embodiment trapping means 20 is formed from a plurality of generally arcuate, spaced apart and parallel retaining members 40 having opposite ends seared to the bottom member 22. Each retaining member 40 is spaced apart by a predetermined distance so as to trap within the members 22 selected sizes of particulate matter. The retaining members 40 are also semi-flexible and are arranged to spread apart whenever particulate 12 of dimensions greater than the lateral spacings therebetween are encountered during descent. Once penetrated and during lifting the retaining members 40 will return to their undeformed condition. Likewise the lifting forces are less than the driving forces so that the larger size particles are retained whenever the surficial dredging apparatus is lifted. It will be appreciated that the retaining members 40 act in substantially the same way to trap the particulate.

While the invention has been described in connection with the foregoing preferred embodiments, it is not intended to limit the invention to the particulate forms set forth above, but, on the contrary, it is intended to cover such alternatives, modifications, and equivalents as may be included within the spirit and scope of the invention as defined by the appended claims.

What is claimed is:

1. Surficial dredging apparatus for automatically and selectively retrieving a plurality of particulate minerals of at least predetermined size from on and embedded in the surface of the ocean seabed comprising first means for providing sufficient downwardly driving forces for enabling said first means to at least partially penetrate the ocean seabed and for receiving the particulate minerals therein; second means operatively connnected to said first means and being actuable for providing sufficient positive buoyant force for extricating said first means from the seabed and for returning said apparatus toward the ocean surface; and third means operatively connected to said first means for permitting the passup of particulate minerals on and embedded in the seabed surface therepast into said first means whenever downwardly penetrating the seabed and for automatically and selectively trapping a plurality of particulate minerals of at least predetermined sizes in said first means whenever said first means in being extricated from the seabed and ascending towards away from the ocean floor in response to actuation of the said second means, said second means is comprised of an inflatable member connected to the tubular member and upon actuation providing a sufficient positive buoyant force for extricating the first means and said third means from the seabed, wherein said positive buoyant force is less than the downwardly driving force of the first means.

2. An apparatus as set forth in claim 1 in which said first means is comprised of an open ended tubular member.

3. An apparatus as set forth in claim 2 in which said third means is comprised of a multiplicity of generally flexible and elongated trapping members each having one end attached in and adjacent one of said open ends and being circumferentially spaced from the others and projecting generally radially inwardly toward a longitudinal axis of the tubular member.

4. An apparatus as set forth in claim 3 in which said members are fabricated from a material such that they can spread apart as a result of contact with the mineral particulate of a size which exceeds the distance defined by the circumferentially spaced members whenever the tubular member penetrates the seabed and being sufficiently rigid to lift the mineral particulate.

5. An apparatus as set forth in claim 4 in which said trapping fingers are defined by elongated rod like members wherein alternate ones of said fingers are of a length shorter than the adjacent fingers.

6. An apparatus as set forth in claim 5 in which said second means further includes a self-contained gaseous producing means for producing the necessary gaseous matter which expands the inflatable member.

7. An apparatus as set forth in claim 2 in which said third means includes members which are generally arcuate and have opposite ends connected to and beneath said tubular member, said trapping members being generally spaced apart and parallel to each other and being spaced by a distance which automatically, selectively and reliably traps particulate matter of preselected size during penetration of extraction.

* * * * *